US007587768B2

(12) United States Patent
Wong

(10) Patent No.: US 7,587,768 B2
(45) Date of Patent: Sep. 15, 2009

(54) GARMENT WAISTBAND

(75) Inventor: John Wong, Hong Kong (CN)

(73) Assignee: Taltech Ltd., Tortola (VG)

( * ) Notice: Subject to any disclaimer, the term of this patent is extended or adjusted under 35 U.S.C. 154(b) by 1359 days.

(21) Appl. No.: 10/233,619

(22) Filed: Sep. 4, 2002

(65) Prior Publication Data

US 2004/0040070 A1 Mar. 4, 2004

(51) Int. Cl.
*A41F 9/00* (2006.01)

(52) U.S. Cl. ..... 2/236

(58) Field of Classification Search ..... 2/236–237, 2/221, 76, 220, 311, 335, 331; 139/383 R; 442/181–303
See application file for complete search history.

(56) References Cited

U.S. PATENT DOCUMENTS 3,170,166 A * 2/1965 Weiss ..... 2/132
3,292,184 A * 12/1966 Anderson ..... 2/221
3,602,916 A * 9/1971 Aach ..... 2/48
3,703,008 A * 11/1972 Hudson ..... 2/237
3,869,728 A * 3/1975 Spencer ..... 2/221
4,523,337 A 6/1985 Leibowitz

FOREIGN PATENT DOCUMENTS

GB 664 605 B1 1/1952
GB 1 463 400 B1 2/1977
JP S54-156747 12/1979

* cited by examiner

*Primary Examiner*—Shaun R Hurley
*Assistant Examiner*—Andrew W Sutton
(74) *Attorney, Agent, or Firm*—Bradford Kile, Esq.; Kile Goekjian Reed & McManus

(57) ABSTRACT

A garment waistband having vertical stability and a concomitant ability to provide circumferential length variation to enable a garment to be a comfortable fit despite variations in waist size.

13 Claims, 4 Drawing Sheets

GARMENT WAISTBAND

BACKGROUND OF THE INVENTION

1. Field of the Invention

This invention relates to garments utilizing a waistband. More specifically, this invention relates to a waistband for pants, skirts and other garments that utilize a waistband, regardless of the type of fabric, which is designed to enable the waistband to adjust to slight variations in waist size, while maintaining structural vertical firmness and thereby making it more functional and comfortable to a wearer. The subject waistband, using conventional pant and dress materials, allows for up to 6% expansion and good recovery as well as vertical, anti-roll, stability. Further, the variable increase in length of the waistband can compensate for shrinkage after washing. The subject waistband also makes pants or other garments utilizing a waistband, such as shorts, skirts, etc., easier to button or secure and maintain a good fit during wear.

2. Description of the Prior Art

The circumference of the waist and the length of the inseam represent the sizes in which pants and other garments utilizing waistbands are commonly sold. Presently manufacturers make pants and other garments utilizing waistbands with waist sizes varying in one to two inch increments. These incremental sizes allow most users to find a fit, but require many different sizes to be manufactured and held in inventory. Moreover, in some size ranges, it is common for men's pants to be manufactured in two inch increments, creating the problem of non-fitting garments for those in between two manufactured sizes. Moreover, over time, one's waist size may vary slightly and a certain waist size that once was comfortable may become tight fitting and uncomfortable. Still further, even the process of securing the waistband can be uncomfortable when wearing garments with a standard, non-variable waist circumference.

In the past, pants, skirts and other garments utilizing waistbands have been manufactured, which allow the waistband to stretch. However, garments known in the past have usually required the use of different materials or devices to elongate the circumferential length about the waist. Moreover, the garments of the prior art, with a capability of expanding, are usually easily recognized and distinguishable from garments with a non-expandable waistband due to their visual appearance.

Several patents in the prior art have utilized a stretchable lining material in the waistband. At least one prior patent teaches a waistband that increases and decreases in size by means of construction. However, the stretchability of this device is due to a special waistband liner, which includes a number of elastic strands. Another prior art design utilizes a stretchable banding material to create a stretchable waistband. In yet another design an elastic strip is utilized within a waistband, which reinforces the waistband and is reputed to address unsightly appearance of the garment due to bunching, rolling and twisting.

Other suggested designs include constructing expandable waistbands that can be made of the same fabric or material as the rest of the garment by providing slits in a waistband to accommodate changes in waist size. Another example of an expandable waistband that may be constructed from the same fabric or material as the garment teaches a waist construction, which includes an elongated section of a waistband that joins opposite ends of the waistband and a cut or folded section that joins the opposite edges of the body of the garment, whereby the waist is narrowed or enlarged by selecting alignment of the opposite ends.

In addition to stretchable waistbands, a shirt collar is known, which is capable of enlargement because the fabric of the collar is cut on a bias, allowing the collar to elongate circumferentially around the neck of a wearer. However, this collar invention does not address the specific concerns in waistband construction. Collar construction does not need to address the common waistband problem of vertical stability to prevent rolling over due to the physical girth of a particular wearer. Furthermore, variations in neck or collar size do not vary as much as waist size for a given wearer. A waistband must be able to elongate circumferentially much more than a shirt collar.

Accordingly, there is a need for a simple and desirable means of constructing an expandable waistband for pants, skirts and other garments, utilizing a waistband made out of fabric, which may be comprised of the same material as the rest of the garment, and does not utilize slits, folds, or elastic. Moreover, there is a need to enable the size of the waistband to expand or contract to compensate for fluctuations in the waist size of a user, and to allow a garment manufactured in a single waist size to fit persons having different waist sizes, without requiring additional manufacturing steps or producing a noticeably different appearance to the wearer or others who can observe the waistband. Still further, there is a need for a garment waistband that has vertical stability that resists a tendency of the waistband to fold over or roll down during wear.

OBJECTS OF THE INVENTION

It is a general object of the invention to provide a novel garment waistband that will eliminate or minimize problems and limitations of the type previously described.

It is a specific object of the invention to provide a novel garment waistband with an ability to expand about the waist of a wearer without altering the appearance of the garment.

It is a further object of the invention to provide a novel waistband of a garment that will exhibit a capacity to expand laterally while concomitantly maintaining vertical stability to resist a tendency to collapse or roll down when the garment is worn.

Another object of the invention is to provide a garment with an expandable waistband that increases comfort to a wearer.

It is a related object of the invention to provide a garment with an expandable waistband that is operable to facilitate securing the waistband of a garment about the waist of a wearer.

Another object of the invention is a waistband of a garment of improved usefulness and durability, allowing for vertical stability while concomitantly accommodating fluctuations in waist size of a wearer.

SUMMARY OF THE INVENTION

The present invention provides a means for constructing a waistband, which allows for fluctuations in a user's waist size. This allows for a more comfortable fit. The present invention provides manufacturers with an option of producing and stocking fewer incremental sizes, and does not require additional manufacturing steps while producing an appearance that is not noticeable to a customer. The present invention allows circumferential elongation of the waistband while concomitantly providing a firm vertical construction that prevents the waistband from rolling over. Further, pants, skirts, or other garments remain comfortable to wear even when the waist size of a wearer varies after purchase of the garment.

The foregoing is achieved by having the fabric and interlining of the waistband specifically constructed. More specifically, the exeterior of the waistband, i.e., an outer fabric of the waistband, is fabricated of the pant or skirt fabric, while an interior portion of the waistband is provided with an interlining. Both of the waistband materials, the outer fabric of the waistband and the interlining, are cut such that warp threads of the fabric extend at an angle with respect to an upper edge of the waistband. Preferably the warp threads of the outer fabric of the waistband extend at approximately a forty-five degree (45°) angle with respect to the upper edge of the waistband. The warp threads of the interlining would preferably be at approximately an opposing forty-five degree (45°) angle so that the warp threads of the outer fabric of the waistband are at approximately a ninety degree (90°) angle with respect to the warp threads of the interlining. With this arrangement, when tension is applied along the length of the waistband, the fabric of the outer fabric of the waistband and interlining expands, from an approximate square configuration to a parallelogram effectively lengthening the waistband while retaining vertical stiffness desirable to prevent unwanted vertical crumple or roll of the waistband during active wear.

The manufacture of pants or other garments in accordance with the subject invention does not incur significantly different costs compared with the manufacture of conventional garments. It is necessary only to lay the material that forms the waistband and interlining so that the warp threads are on a bias when the material is cut. The present invention does not require any substantial changes in the manufacturing process, because it is only necessary to position the materials that form the waistband so that the weave is on the desired bias.

Furthermore, if desired, manufacturers even have an option of producing fewer sizes, allowing for less inventory when pants, skirts, and other garments utilizing a waistband are made according to the invention. For instance, a manufacturer that produces pants in size increments of one inch could change to a more efficient production of size range increments of two inches, e.g., 32-33, 34-35, 36-37, etc. Alternatively, there could be no reduction in the number of sizes manufactured when the subject waistband is utilized with the purpose of merely providing a more comfortable fit for wearers.

DRAWINGS

Other objects and advantages of the present invention will become apparent from the following detailed description of preferred embodiments thereof taken in conjunction with the accompanying drawings, wherein.

Figure 3:
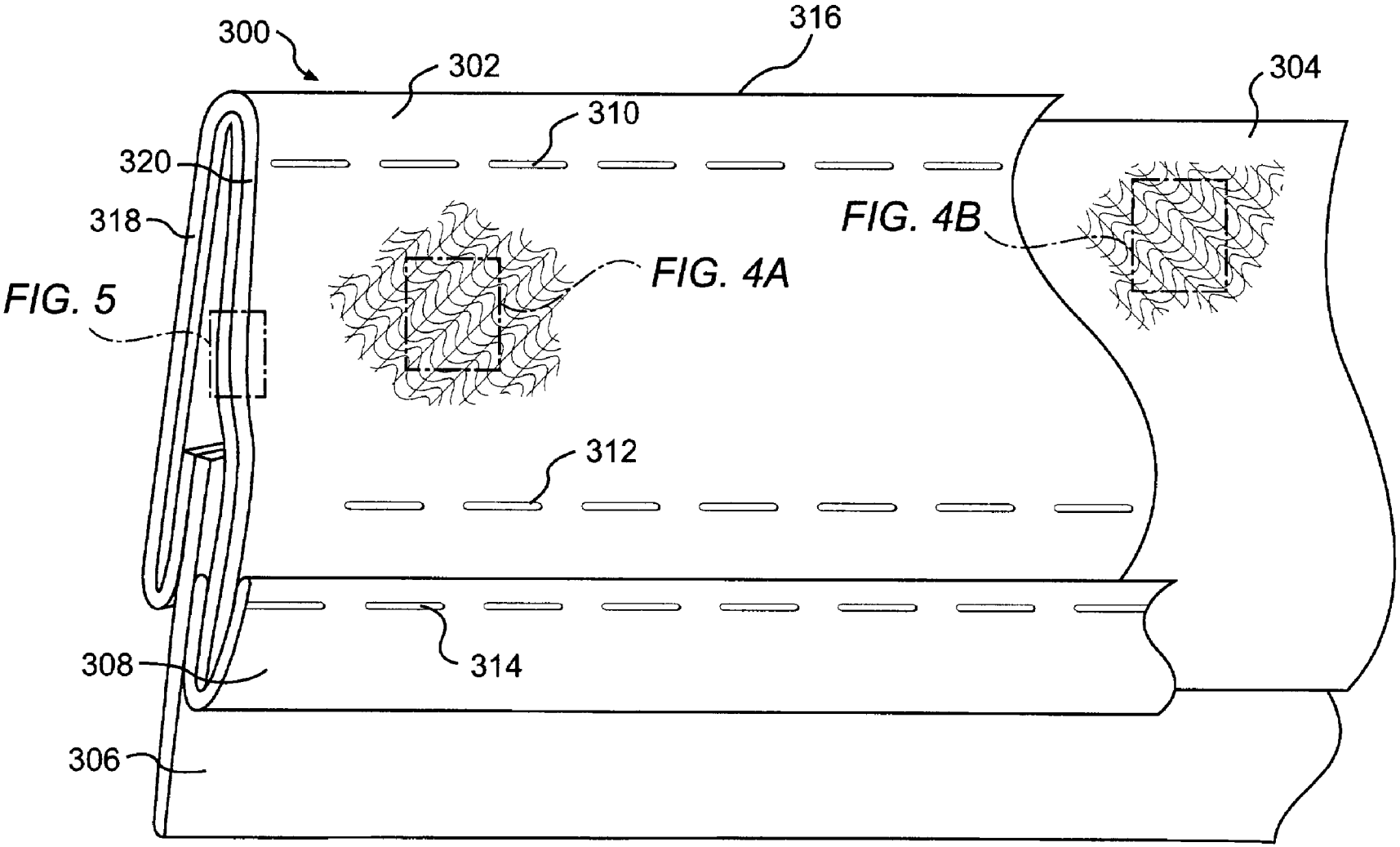
FIG. 3 is a cross-sectional perspective view of a portion of the subject waistband connected to a body of a garment.
Figure 4B:
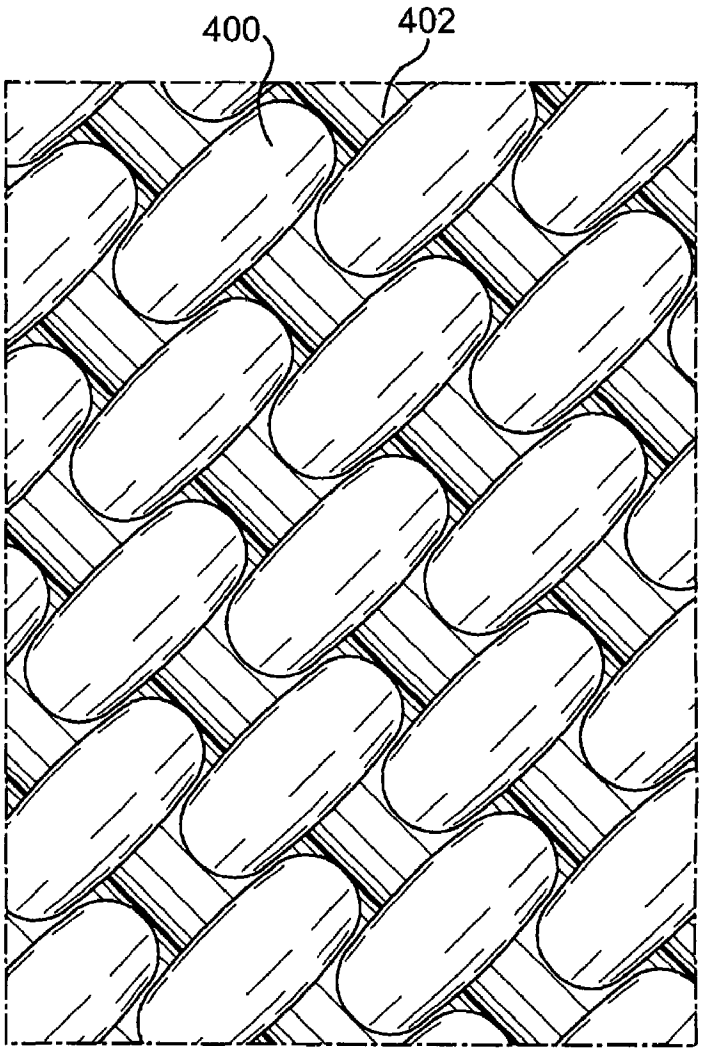
Figure 4A:
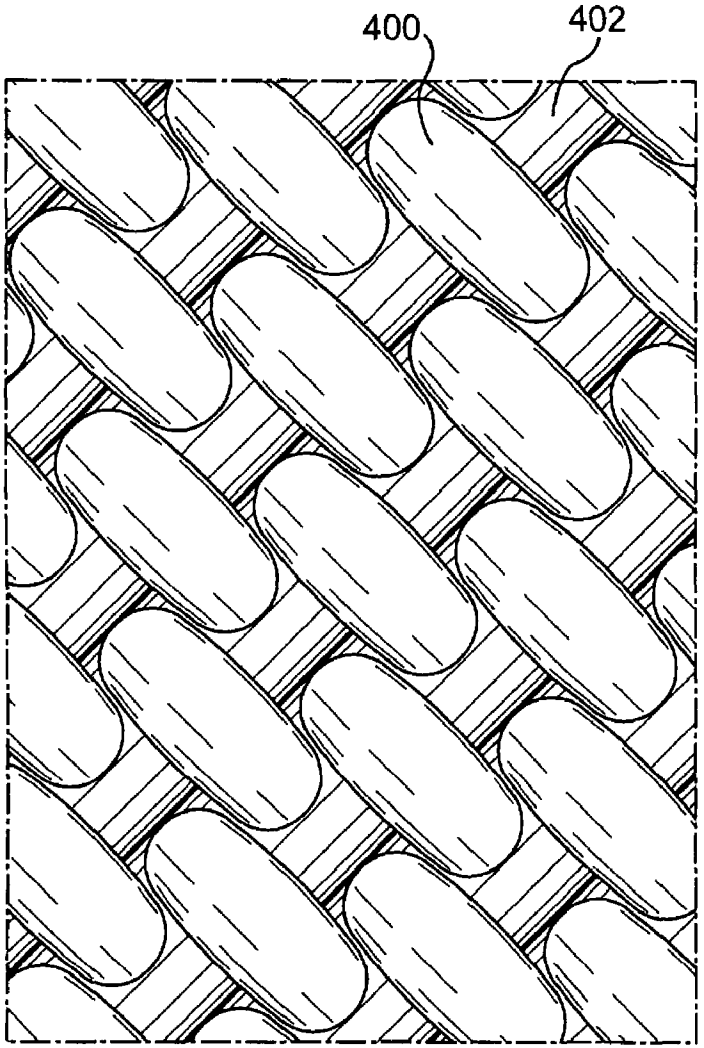
Figure 5:
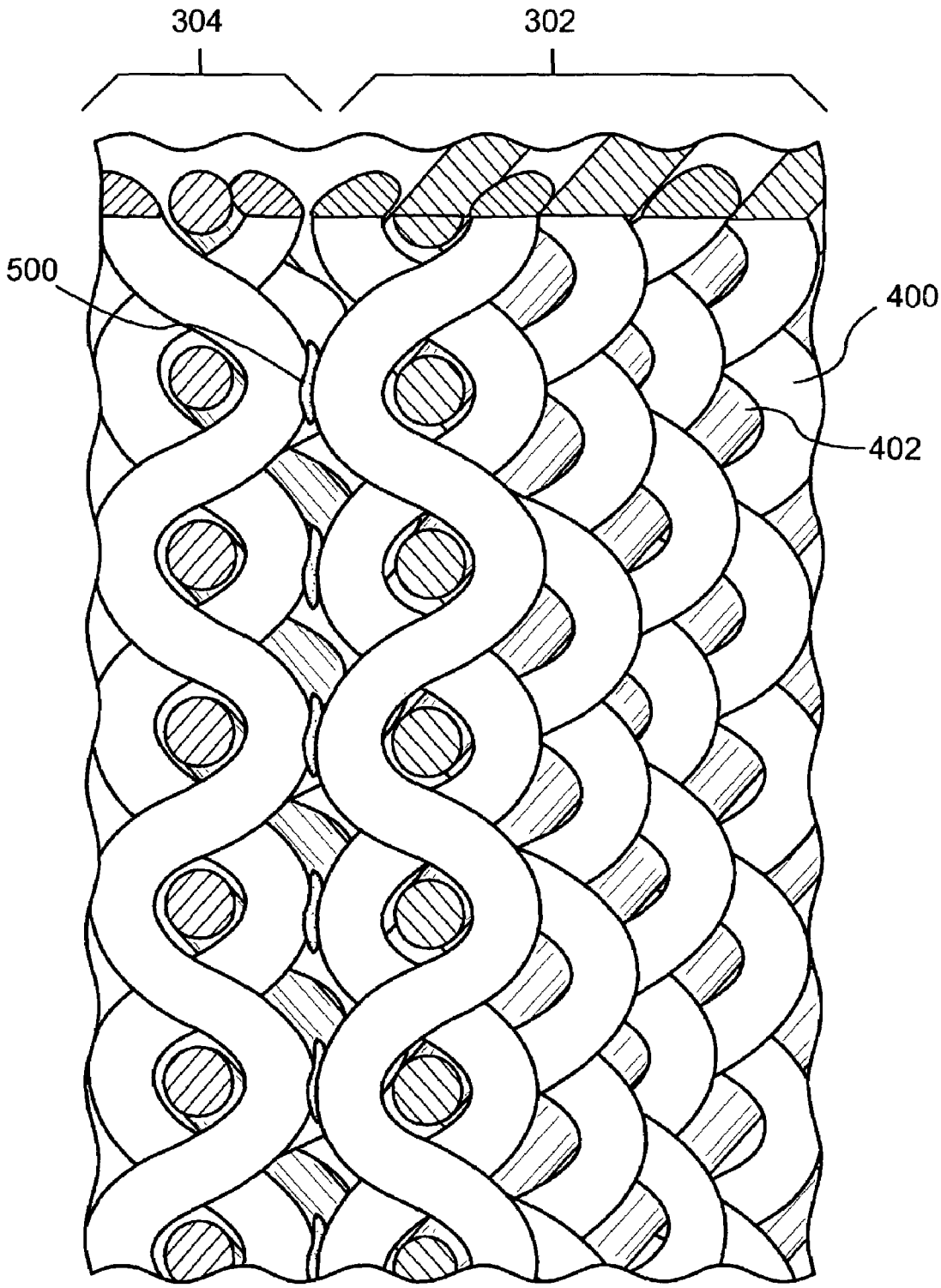

FIG. 4*a* is an enlarged view of a segment of FIG. 3 illustrating the material of the outer fabric of the waistband cut at an angle with respect to an upper edge of the waistband;

FIG. 4*b* is a similar enlarged view of FIG. 3 illustrating the material of the interlining of a waistband cut at angle, wherein the warp thread of the interlining is at a ninety degree (90°) angle with respect to the warp threads of the outer fabric of the waistband; and FIG. 5 is a detail view of an edge portion taken from FIG. 3 illustrating orientation of warp threads of the fabric and the relationship between the interlining and the outer fabric of the waistband.

DETAILED DESCRIPTION

Figure 2:
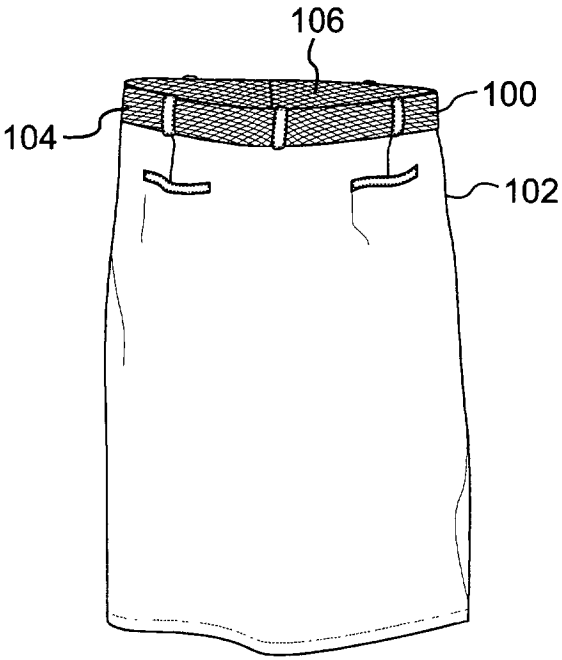
FIG. 2 is an illustration of the back of a skirt garment utilizing a waistband in accordance with the invention.
Figure 1:
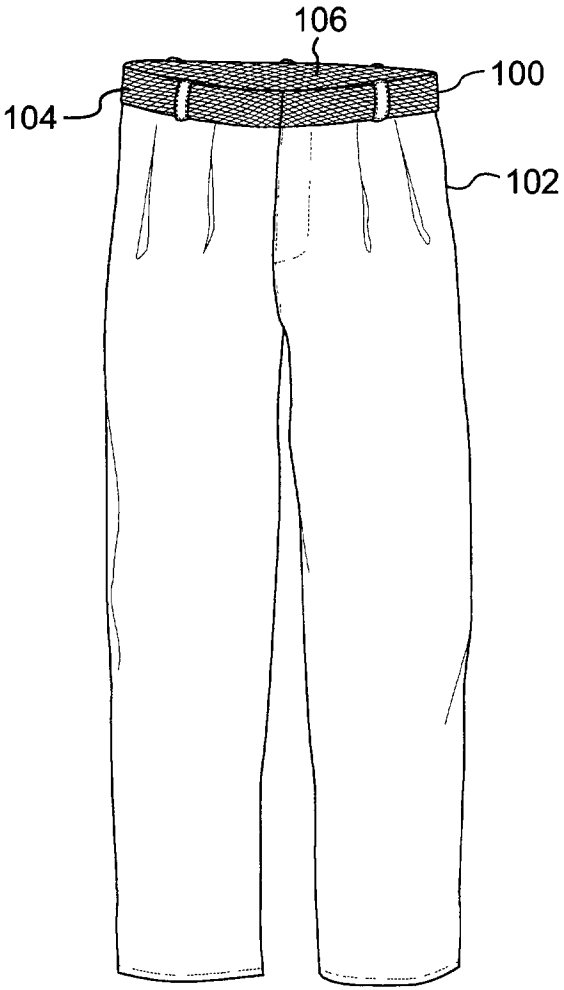
FIG. 1 is an illustration of the front of a pant garment utilizing a waistband that is capable of elongation in accordance with the invention, wherein the waistband is dramatized to show angular orientation of the warp threads, however, when in commercial products this orientation will not be visible.

Referring to the drawings, particular embodiments of the present invention illustrates the advantages of the subject waistband. Referring to FIG. 1 and FIG. 2, the front and back of a garment utilizing an expandable waistband are shown, respectively. More specifically, FIG. 1 shows the front side of a pair of pants, and FIG. 2 shows the back side of a skirt. However, other garments fitting around the waist of a wearer such as shorts, dresses, and slacks, may utilize a waistband 100. The waistband 100 has an exterior side 104 and an interior side 106. The body of a garment 102 is attached to the garment waistband 100, and the waistband 100 secures the garment about the waist of a wearer by means of a fastening device or other device commonly used for securing a waistband about the waist of the wearer.

The present invention differs significantly from conventional garments utilizing waistbands with respect to the ability to conform to variations in waist size, however, the visual appearance of the garment waistband is relatively unnoticeable compared to the appearance of conventional garments. Moreover, the present invention enables pants and other garments utilizing a waistband to be made and stocked in fewer sizes, and insures that a garment will remain comfortable to wear even when the waist size of the wearer changes slightly, or in the event that the garment should shrink when laundered. In addition to the above features the waistband also provides vertical stiffness, preventing crushing or rolling over of the waistband, which is a common problem in some waistband constructions in the prior art.

The present invention achieves these results by orienting the weave of the fabric or other material comprising the waistband at an angle with respect to an upper edge of the garment waistband. The threads forming the material of the waistband extend at an angle to the longitudinal axis or circumferential direction of the waist. When the material or fabric of the waistband is oriented such that they extend at an angle with respect to the upper edge of the waistband it facilitates elongation when force is applied in a direction parallel to the longitudinal axis or circumference of the waist. Further, expandability is attained when the weave is cut on an angle, ranging from about 15 degrees to about 85 degrees relative to the longitudinal axis of the waistband. Orienting the weave on such an angle with respect to the upper edge allows the waist size of the waistband to expand up to six percent circumferentially when force is applied, and also allows for good recovery from elongation. The present invention does not rely on the use of elastic, slits, extra folds, or any other device or construction that deviates from conventional construction beyond orientation of the weave.

Referring to FIG. 3, a cross-sectional perspective drawing of a garment waistband is shown, in its preferred embodiment, from the interior side of the waistband. This section of a garment waistband 300 illustrates the construction. A reversely folded fabric element 302 is a continuous piece of fabric that is the most visible aspect of the waistband and substantially gives the waistband its shape. The reversely folded fabric element 302 is comprised of an outer circumferential fabric panel 318 and an inner circumferential fabric panel 320. The outer circumferential fabric panel 318 folds under on the bottom of the exterior side of the waistband 302. The inner circumferential fabric panel 320 is encompassed by an interior waistband lip 308 on the bottom edge of the interior side of the waistband. Stitching 310 creates an upper edge 316 of the waistband 300 and forms a ridge separating the exterior from the interior of the waistband, and the outer circumferential fabric panel 318 from the inner circumferential fabric panel 320, by going through the reversely folded fabric element 302 and the interlining 304 on both the interior and exterior side of the waistband. The stitching 310 also permits the elongation of the waistband.

In the preferred embodiment of the invention the reversely folded fabric element 302 is made from the same material or fabric as the garment body 306, although it does not have to be, and the weave of the fabric comprising the reversely folded fabric element 302 is oriented so that the threads extend at an angle with respect to the upper edge 316, as illustrated by FIG. 4A. These aspects of the present invention allow the garment to have the appearance of a conventional garment, while still being capable of stretching and providing vertical stiffness.

Referring to FIG. 4A, a blown-up view of FIG. 3, a detailed view of the weave of the reversely folded fabric element 302 oriented so that the threads extend at an angle with respect to the upper edge 316 is shown. The warp 402 is the straighter, higher tension thread of the fabric's weave. The woof 400 is more relaxed and stretchable than the warp 402, and there is usually no tension on the woof 400 except during chain mercerization and stentering.

Conventional construction of waistbands for garments such as slacks, pants, shorts, skirts, etc. is to orientate the weave so that it perpendicular and parallel to the upper edge of the waistband or the circumference of the waist. In other words, the weave of the waistband fabric or material is usually orthogonal relative to the longitudinal axis or circumferential direction of the waistband. More specifically, the warp or woof are cut to be parallel and perpendicular to the circumference of the waist. Little to no elongation occurs when the fabric of a waistband is oriented in this way.

The waistband interlining 304 is adjacent to the interior of the reversely folded fabric element 302 and can be fusible or nonfusible, however, the interlining 304 does not fold under like the outer circumferential fabric panel 318 does on the exterior side of the waistband 300. The interlining 304 may be folded over to form a double layer of material, as shown in FIG. 3, or the interlining may be a single fabric layer of material and the interlining being transversely stiffer than said outer circumference fabric panel 318 and/or said inner circumference fabric panel 320. The waistband interlining 304 is used as a support of the waistband 300, resulting in smoother garment appearance and firmness.

The warp threads of a waistband interlining 304 are oriented to extend at an angle with respect to the upper edge 316, as illustrated by FIG. 4B (see description of FIG. 4A above), to allow the waistband 300 to conform to variations in the waist size of the wearer. The angle of the interlining 304 does not have to be the same as the angle of the reversely folded fabric element 302, with respect to the upper edge 316. Normally the interlining 304 is slightly lighter and thinner than the reversely folded fabric element 302, and it is common for the interlining 304 to be made of a different fabric or material than the reversely folded fabric element 302, although it does not have to be. The weave of different fabric or materials when oriented at the same angle with respect to the upper edge 316 usually exhibit different abilities to expand. Moreover, the optimum angle depends on the fabric construction and also the degree of desired expansion. Thus, it is sometimes beneficial to have different angles for the reversely folded fabric element 302 and the interlining 304 when they are made of different fabrics or materials to allow for maximum expandability and significant vertical stiffness.

When a fabric extends at an angle with respect to the upper edge of the waistband the fabric structure is distorted allowing the waistband to stretch when force is applied, as opposed to a fabric that is not oriented at such an angle, which applies force on the rigid yarn and results in little to no stretch. However, the angle and resulting expandability of either the reversely folded fabric element or interlining can restrict the amount of elongation in a waistband. For instance, if the interlining has maximum expandability when the weave is oriented at approximately a 45 degree angle, with respect to the upper edge of the waistband, exceeding the maximum expandability of any angle of the reversely folded fabric element, then the expandability of the fabric of the reversely folded fabric element will dictate the expandability of the entire waistband.

Another component of the garment waistband 300 in which the weave is oriented to extend at an angle with respect to an upper edge 316, is the interior waistband lip 308. The interior waistband lip 308 encompasses the lower portion of the inner circumferential fabric panel 320 and the waistband interlining 304 on the interior side of the waistband. The interior waistband lip 308 is connected at opposite ends by stitching 314 that goes through the interlining 304 and inner circumferential fabric panel 320 on the interior side of the waistband. The stitching 314 also permits stretching of the waistband 300. The interior waistband lip 308 prevents the inner circumferential fabric panel 320 and interlining 304 from becoming frayed and separated.

The reversely folded fabric element 302 and interlining 304 are connected to the garment body 306 by stitching 312 that goes through the reversely folded fabric element 302 on both the inner circumferential fabric panel 320 and the outer circumferential fabric panel 318, the interlining 304, and the garment body 306. Further, the stitching 312 allows the outer circumferential fabric panel 318 to remain folded under, and permits the waistband to expand.

Referring to FIG. 5, a blown-up view of the cross-section of FIG. 3, the relationship between the waistband interlining 304 and the reversely folded fabric element 302 is shown. In one embodiment of the invention the interlining 304 is bonded to the underside of the reversely folded fabric element 302 by an adhesive 500. Various types of adhesives can be used to bond the interlining to the outer fabric of the waistband, including, but not limited to, high and low density polyethylene, polyamide and polyester. The adhesive 500 only bonds the reversely folded fabric element 302 and interlining 304 at certain touch points, allowing distortion of the fabric of both the interlining and the reversely folded fabric element when force is applied. Alternatively, the reversely folded fabric element 302 and the interlining 304 do not have to be bonded by an adhesive. The interlining 304 and reversely folded fabric element 302 can maintain their relative positions by stitching throughout the waistband construction.

The present invention enables the waist size to increase up to six percent, depending on the fabric or material. This increase in size enables fewer sizes to be manufactured and stocked, makes the garment more comfortable to wear, and makes it easier to button. The present invention also provides a garment waistband having vertical stiffness, preventing crushing or rolling over. Additionally, waistband sizes can be manufactured in ranges as opposed to approximate waist sizes. Moreover, this increase in the effective length or circumference of the waistband is accomplished without any noticeable change in the appearance of the garment.

While particular embodiments of the invention have been illustrated and described in detail herein, it should be understood that various changes and modifications may be made to the invention without departing from the spirit and intent of the invention as defined by the scope of the appended claims.

SUMMARY OF MAJOR ADVANTAGES OF THE INVENTION

After reading and understanding the foregoing detailed description of a garment waistband and method of creation in accordance with preferred embodiments of the invention, it will be appreciated the several distinct advantages are achieved.

Without attempting to detail all of the advantages that are specifically disclosed or are inherent in the complete disclosure, the construction of a waistband from material with warp threads extended at an angle with respect to an upper edge of a garment waistband will allow the waistband to stretch up to six percent when force is applied and allows recovery when force is removed. The construction of the waistband also provides vertical stiffness, preventing crushing and roll-over.

Additionally, having a garment waistband comprised of fabric nullifies the necessity of elastic, folds, slits, or other devices or constructions that alter the appearance of a waistband to allow stretching, and allows the waistband to have an unnoticeable appearance in comparison to conventional garments.

The difficulties, limitations and desires suggested in the preceding are not intended to be exhaustive, but rather are among many which demonstrate that prior art devices for garment waistbands will admit to worthwhile improvement.

What is claimed is:

1. A garment waistband for a pant, skirt, or the like, said waistband comprising:

an outer circumferential fabric panel having warp and generally orthogonal woof threads, said outer circumferential fabric material being cut such that the warp threads extend at an angle with respect to an upper edge of said waistband;

an inner circumferential fabric panel having warp and generally orthogonal woof threads, said inner circumferential fabric material being cut such that the warp threads extend at an angle with respect to an upper edge of said waistband;

said outer circumferential fabric panel and said inner circumferential fabric panel comprising a single fabric element and being reversely folded along a median line defining said upper edge of said waistband, wherein the warp thread of said outer circumferential fabric panel extend at an angle with respect to the warp thread of said reversely folded portion of said inner circumferential fabric panel;

said warp threads of said outer circumferential fabric panel extend at said angle of approximately ninety degrees (90°) with respect to warp threads of said reversely folded portion of said inner circumferential fabric panel;

an interlining, having warp and woof threads and being coextensive with an interior portion of said reversely folded single fabric element; and said interlining being cut such that the warp threads extend at an angle with respect to the upper edge of said garment waistband.

2. A garment waistband for a pant, skirt, or the like as defined in claim 1, wherein:

said interlining warp threads extend at said angle of approximately ninety degrees (90°) with respect to warp thread of at least one of said inner circumferential fabric panel or said outer circumferential fabric panel.

3. A garment waistband for a pant, skirt, or the like said waistband comprising:

an outer circumferential fabric panel composed of the material of said garment and having warp and generally orthogonal woof threads, said outer circumferential fabric panel material being cut such that the warp threads extend at an angle with respect to an upper edge of said waistband;

an inner circumferential fabric panel having warp and generally orthogonal woof threads, said inner circumferential fabric panel material being cut such that the warp threads extend at an angle with respect to an upper edge of said waistband; and at least one interlining panel composed of a fabric having warp and woof threads and being cut such that the warp threads extend at an angle with respect to an upper edge of said waistband, wherein circumferential tension imparted to the waistband will enable the waistband to elongate while concomitantly maintaining transverse firmness of the waistband construction;

said at least one interlining panel having warp and woof threads is positioned between said outer circumferential fabric panel and said inner circumferential fabric panel and an outer surface of said interlining panel is bonded with an adhesive at adjacent outer touch points with at least one of an inner surface of said outer circumferential fabric panel and an inner surface of said inner circumferential fabric panel to provide enhanced vertical rigidity of the waistband and concomitant circumferential extendibility of said garment waistband.

4. A garment waistband for a pant, skirt, or the like, said waistband comprising:

an outer circumferential fabric panel composed of the material of said garment and having warp and generally orthogonal woof threads, said outer circumferential fabric panel material being cut such that the warp threads extend at an angle with respect to an upper edge of said waistband;

an inner circumferential fabric panel having warp and generally orthogonal woof threads, said inner circumferential fabric panel material being cut such that the warp threads extend at an angle with respect to an upper edge of said waistband; and at least one interlining panel composed of a fabric having warp and woof threads and being cut such that the warp threads extend at an angle with respect to an upper edge of said waistband, wherein circumferential tension imparted to the waistband will enable the waistband to elongate while concomitantly maintaining transverse firmness of the waistband construction;

said at least one interlining panel comprises:

a first circumferential panel extending generally coextensively with said outer circumferential fabric panel of said waistband and being bonded with an adhesive to a plurality of touch points between said interlining first circumferential panel and said outer circumferential fabric panel; and a second circumferential panel extending generally coextensively with said inner circumferential fabric panel of said waistband and being bonded with an adhesive to a plurality of touch points between said interlining second circumferential panel and said inner circumferential fabric panel.

5. A garment waistband for a pant, skirt, or the like said waistband comprising:

an outer circumferential fabric panel composed of the material of said garment and giving warp and generally orthogonal woof threads, said outer circumferential fabric panel material being cut such that the warp threads extend at an angle with respect to an upper edge of said waistband;

an inner circumferential fabric panel having warp and generally orthogonal woof threads, said inner circumferential fabric panel material being cut such that the warp threads extend at an angle with respect to an upper edge of said waistband; and at least one interlining panel composed of a fabric having warp and woof threads and being cut such that the warp threads extend at an angle with respect to an upper edge of said waistband, wherein circumferential tension imparted to the waistband will enable the waistband to elongate while concomitantly maintaining transverse firmness of the waistband construction;

said at least one interlining panel comprises:

a single fabric layer of material and being transversely stiffer than at least one of said outer circumferential fabric panel and said inner circumferential fabric panel.

6. A garment waistband for a pant, skirt, or the like said waistband comprising:

an outer circumferential fabric panel composed of the material of said garment and having warp and generally orthogonal woof threads, said outer circumferential fabric panel material being cut such that the warp threads extend at an angle with respect to an upper edge of said waistband;

an inner circumferential fabric panel having warp and generally orthogonal woof threads, said inner circumferential fabric panel material being cut such that the warp threads extend at an angle with respect to an upper edge of said waistband; and at least one interlining panel composed of a fabric having warp and woof threads and being cut such that the ware threads extend at an angle with respect to an upper edge of said waistband, wherein circumferential tension imparted to the waistband will enable the waistband to elongate while concomitantly maintaining transverse firmness of the waistband construction, said at least one interlining panel comprises:

a first circumferential panel extending generally coextensively with said outer circumferential fabric panel of said waistband;

a second circumferential panel extending generally coextensively with said inner circumferential fabric panel of said waistband;

said first circumferential panel of said interlining having warp threads extending at approximately an orthogonal direction with respect to warp threads of said outer circumferential fabric panel of said waistband; and said second circumferential panel of said interlining having warp threads extending at approximately an orthogonal direction with respect to warp threads of said inner circumferential fabric panel of said waistband.

7. A garment waistband for a pant, skirt, or the like as defined in claim 6, wherein:

said first circumferential panel of said at least one interlining panel is bonded with an adhesive to an inner surface of said outer circumferential fabric panel at a plurality of touch points of contact; and said second circumferential panel of said at least one interlining panel is bonded with an adhesive to an inner surface of said inner circumferential fabric panel at a plurality of touch points of contact.

8. A garment waistband for a pant, skirt, or the like, said waistband comprising:

an outer circumferential fabric panel composed of the material of said garment and having warp and generally orthogonal woof threads, said outer circumferential fabric panel material being cut such that the warp threads extend at an angle with respect to an upper edge of said waistband;

an inner circumferential fabric panel having warp and generally orthogonal woof threads, said inner circumferential fabric panel material being cut such that the warp threads extend at an angle with respect to an upper edge of said waistband;

at least one circumferential interlining panel composed of a fabric having warp and woof threads and being cut such that the warp threads extend at an angle between about 15 degrees and about 85 degrees with respect to an upper edge of said waistband, wherein circumferential tension imparted to the waistband will enable the waistband to elongate while concomitantly maintaining transverse firmness of the waistband construction; and said garment waistband and a garment body are attached together by stitching that forms a seam, said stitching enabling said seam to elongate when a tensile force is applied to said garment waistband.

9. A garment waistband for a pant, skirt, or the like said waistband comprising:

an outer circumferential fabric panel composed of the material of said garment and having warp and generally orthogonal woof threads, said outer circumferential fabric panel material being cut such that the warp threads extend at an angle with respect to an upper edge of said waistband;

an inner circumferential fabric panel having warp and generally orthogonal woof threads, said inner circumferential fabric panel material being cut such that the warp threads extend at an angle with respect to an upper edge of said waistband; and at least one interlining panel composed of a fabric having warp and woof threads and being cut such that the warp threads extend at angle with respect to an upper edge of said waistband, wherein circumferential tension imparted to the waistband will enable the waistband to elongate while concomitantly maintaining transverse firmness of the waistband construction;

said at least one interlining and said outer circumferential fabric panel and said inner circumferential fabric panel comprising a waistband and are formed of warp and woof threads and are cut on a bias so that the warp and woof threads extend at an angle between about 15 degrees and about 85 degrees relative to an edge of said garment waistband.

10. A garment waistband for a pant, skirt, or the like as defined in claim 9, wherein:

the threads forming the warp and woof of the material of said interlining and said garment waistband extend at an angle of about 45 degrees relative to an edge of said waistband.

11. A garment waistband for a pant, skirt, or the like as defined in claim 4, wherein:

said interlining and waistband are attached together at their respective upper and lower edges by stitching that forms a seam, said stitching being operable to enable said seam to elongate when a tensile force is applied to said garment waistband.

12. A garment waistband for a pant, skirt, or the like as defined in claim 6, wherein:

said garment waistband and a garment body are attached together by stitching that forms a seam, said stitching enabling said seam to elongate when a tensile force is applied to said garment waist band.

13. A garment waistband for a pant, skirt, or the like as defined in claim 12, wherein:

said first circumferential panel of said at least one interlining panel is bonded to an inner surface of said outer circumferential fabric panel at points of contact; and said second circumferential panel of said at least one interlining panel is bonded to an inner surface of said inner circumferential fabric panel at points of contact.

* * * * *